US012522970B2

(12) United States Patent
Dunn et al.

(10) Patent No.: US 12,522,970 B2
(45) Date of Patent: Jan. 13, 2026

(54) DOOR ASSEMBLY FOR A COMBINATION LAUNDRY APPLIANCE

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 305 days.

(21) Appl. No.: 18/359,460

(22) Filed: Jul. 26, 2023

(65) Prior Publication Data

US 2025/0034788 A1 Jan. 30, 2025

(51) Int. Cl.
*D06F 39/14* (2006.01)
*D06F 37/10* (2006.01)

(52) U.S. Cl.
CPC ..... *D06F 39/14* (2013.01); *D06F 37/10* (2013.01)

(58) Field of Classification Search
CPC ..... D06F 39/14; D06F 37/10
USPC ..... 68/212
See application file for complete search history.

(56) References Cited

U.S. PATENT DOCUMENTS 9,212,449 B2 12/2015 Fang et al.
2022/0349105 A1* 11/2022 Kellow ..... D06F 34/28

FOREIGN PATENT DOCUMENTS

CN 205368787 U 7/2016
CN 115404681 A * 11/2022 ..... D06F 58/24
KR 101050095 B1 7/2011

OTHER PUBLICATIONS

CN115404681A—machine translation (Year: 2022).*
KR101050095B1—machine translation (Year: 2011).*

* cited by examiner

*Primary Examiner* — Tinsae B Ayalew
(74) *Attorney, Agent, or Firm* — Dority & Manning, P.A.

(57) ABSTRACT

A laundry appliance includes a cabinet defining a front opening, a tub positioned within the cabinet, a wash basket rotatably mounted within the tub, the wash basket defining a chamber for receipt of articles for washing and drying, a conditioning system configured to heat and remove moisture from air flowing therethrough, the conditioning system comprising a compressor, an evaporator, and a condenser, a supply duct fluidly coupled to the conditioning system for providing a flow of process air into the chamber through a supply opening, and a door assembly rotatably mounted to the cabinet to provide selective access to the chamber through the opening. The door assembly includes a door frame rotatably mounted to the cabinet and a window mounted within the door frame, the window defining a low point and a high point, the low point being oriented toward the supply opening.

18 Claims, 8 Drawing Sheets

DOOR ASSEMBLY FOR A COMBINATION LAUNDRY APPLIANCE

FIELD OF THE INVENTION

The present subject matter relates generally to combination washer/dryer laundry appliances, or more specifically, to a door assembly to facilitate an improved drying process in a combination laundry appliance.

BACKGROUND OF THE INVENTION

Laundry appliances are commonly sold in appliance pairs, e.g., a washing machine appliance for washing clothes and a dryer appliance for drying clothes. By contrast, certain conventional laundry appliances are combination washer/dryer units that wash and dry clothes in the same drum. Accordingly, during a washing cycle of a combination laundry appliance, wash fluid is added to the drum, the load of clothes is agitated during an agitation cycle, a rinse cycle is performed, and a spin cycle is used to extract excess water from the load of clothes while a drain pump evacuates the wash fluid in the drum. After the washing operation is complete, the combination laundry may switch to a drying cycle, where the clothes are tumbled as warm, dry air is circulated within the drum.

In order to facilitate a drying cycle of the combination laundry appliance, a motor rotates the drum, e.g., to tumble articles located within a chamber defined by the drum. In addition, combination laundry appliances generally include a system for passing dry, heated air through the chamber in order to dry moisture-laden articles positioned therein. In this regard, the appliance includes a sealed system or a conditioning system for extracting moisture and heating a flow of air passing through the drum. The conditioning system may include a compressor, a condenser, and an evaporator. Typically, an air handler or blower is used to urge the flow of heated air through the chamber to dry the clothes.

Notably, conventional laundry appliance doors extend at least partially into the chamber of the laundry appliance and may at least partially block the flow of heated air through the chamber. For example, the window of a conventional washer/dryer door might block a supply opening of the heated air, thereby reducing the drying efficiency of the unit. Moreover, conventional washer/dryer doors do not have profiles that interact with the flow of heated air to facilitate improved drying performance.

Accordingly, a combination washer/dryer appliance with features for facilitating an improved drying process would be desirable. More specifically, a door assembly for a combination laundry appliance that facilitates desirable airflow would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a laundry appliance is provided including a cabinet defining a front opening, a tub positioned within the cabinet, a wash basket rotatably mounted within the tub, the wash basket defining a chamber for receipt of articles for washing and drying, a conditioning system configured to heat and remove moisture from air flowing therethrough, the conditioning system comprising a compressor, an evaporator, and a condenser, a supply duct fluidly coupled to the conditioning system for providing a flow of process air into the chamber through a supply opening, and a door assembly rotatably mounted to the cabinet to provide selective access to the chamber through the opening. The door assembly includes a door frame rotatably mounted to the cabinet and a window mounted within the door frame, the window defining a low point and a high point, the low point being oriented toward the supply opening.

In another exemplary embodiment, a door assembly for a laundry appliance is provided. The laundry appliance includes a cabinet defining a front opening, a tub positioned within the cabinet, a wash basket rotatably mounted within the tub and defining a chamber, and a supply duct fluidly coupled to a conditioning system for providing a flow of process air into the chamber through a supply opening. The door assembly includes a door frame rotatably mounted to the cabinet to provide selective access to the chamber through the front opening and a window mounted within the door frame, the window defining a low point and a high point, the low point being oriented toward the supply opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
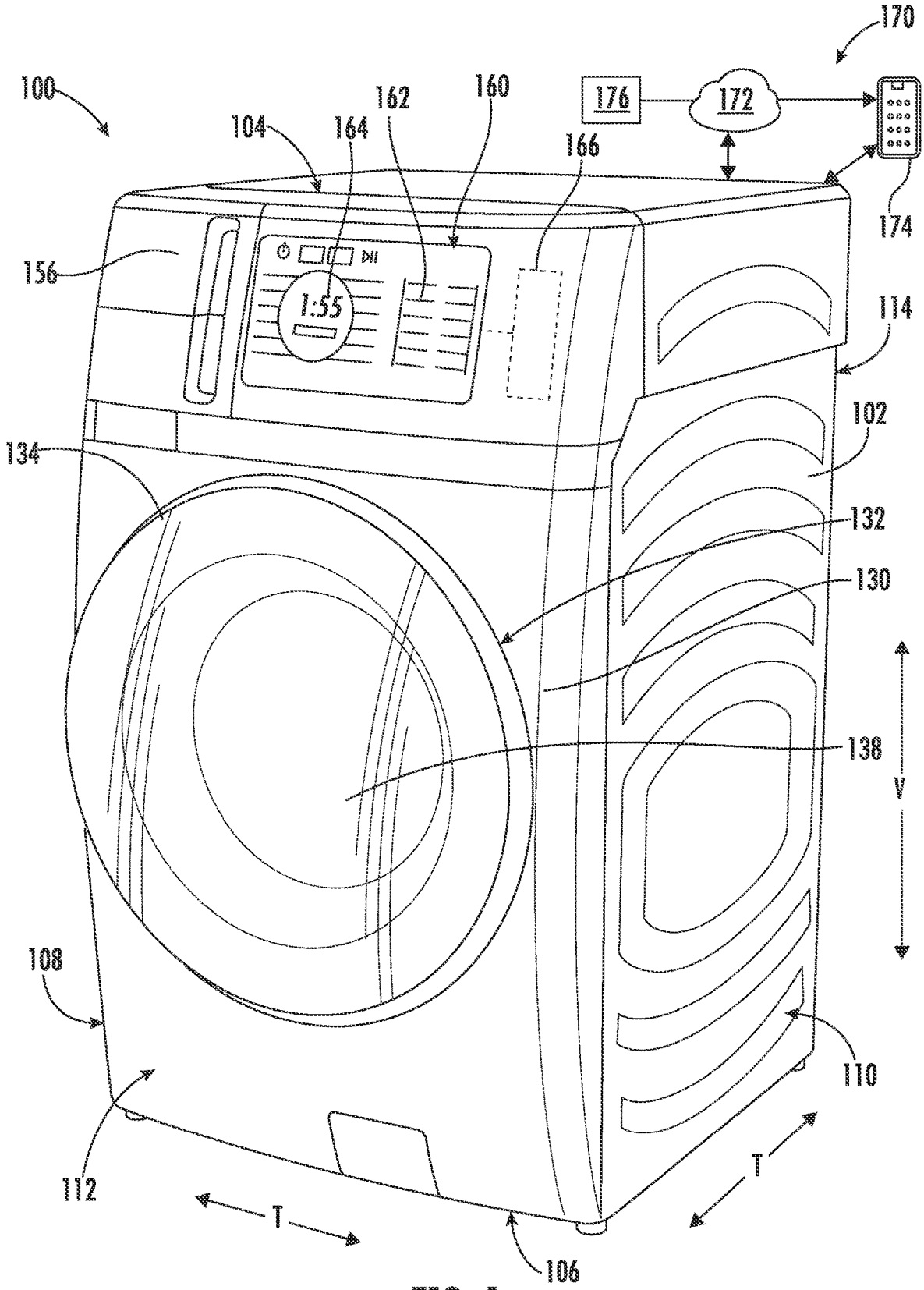
FIG. 1 provides a perspective view of a combination washer/dryer laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
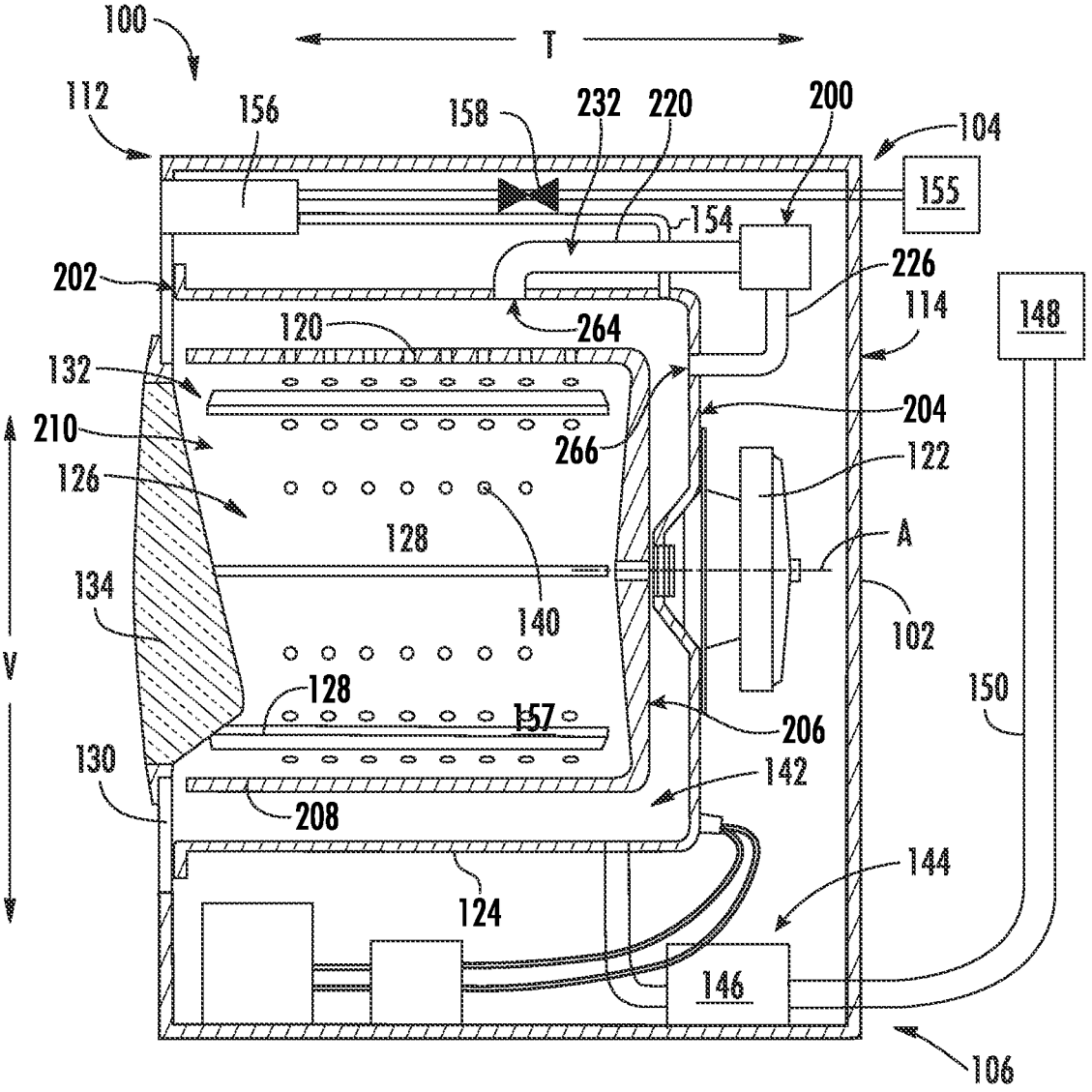
FIG. 2 provides a side cross-sectional view of the exemplary laundry appliance of FIG. 1.
Figure 4:
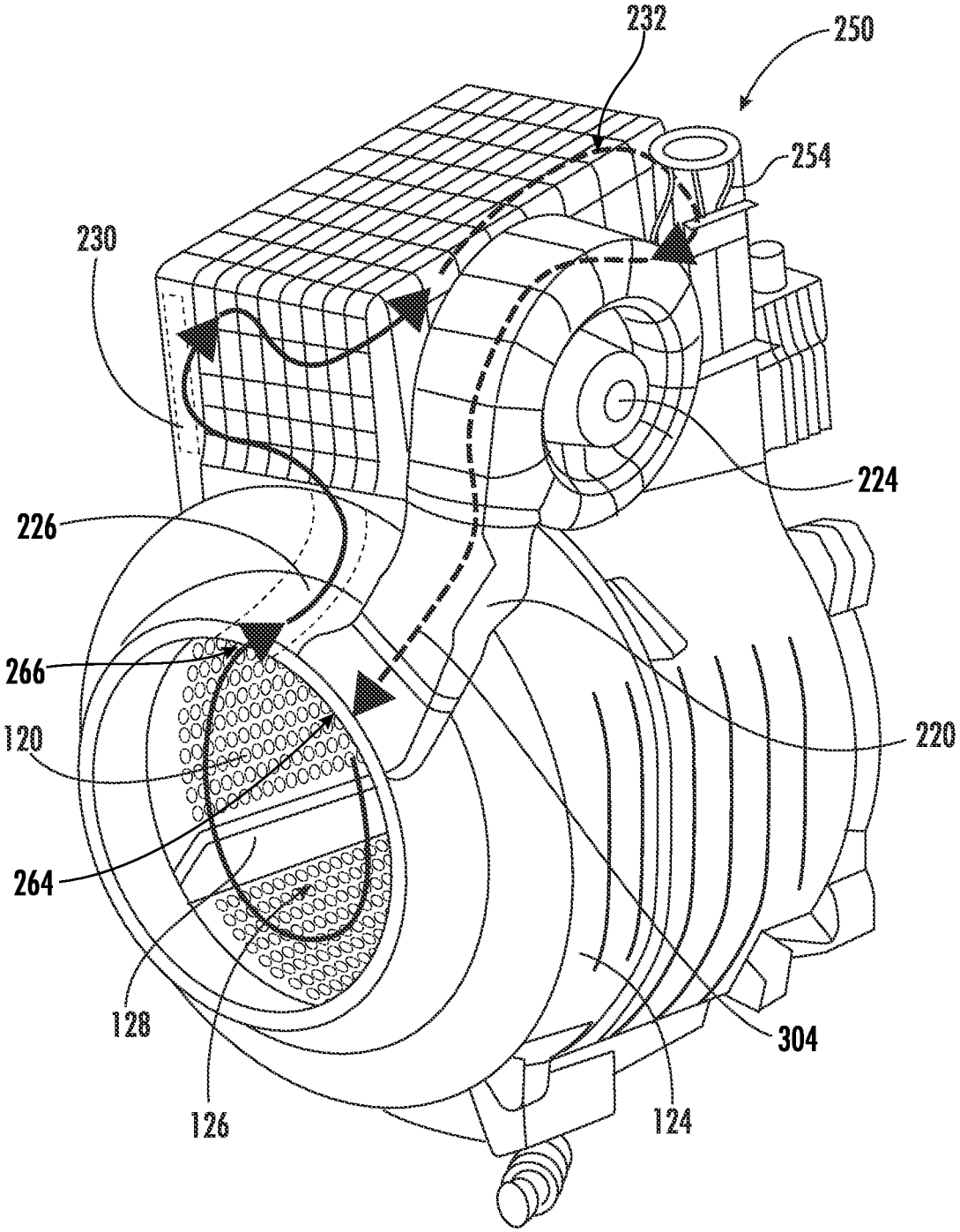
FIG. 4 provides a perspective view of the example laundry appliance of FIG. 1 with a cabinet of the laundry appliance removed to reveal certain components of the dryer appliance.
Figure 5:
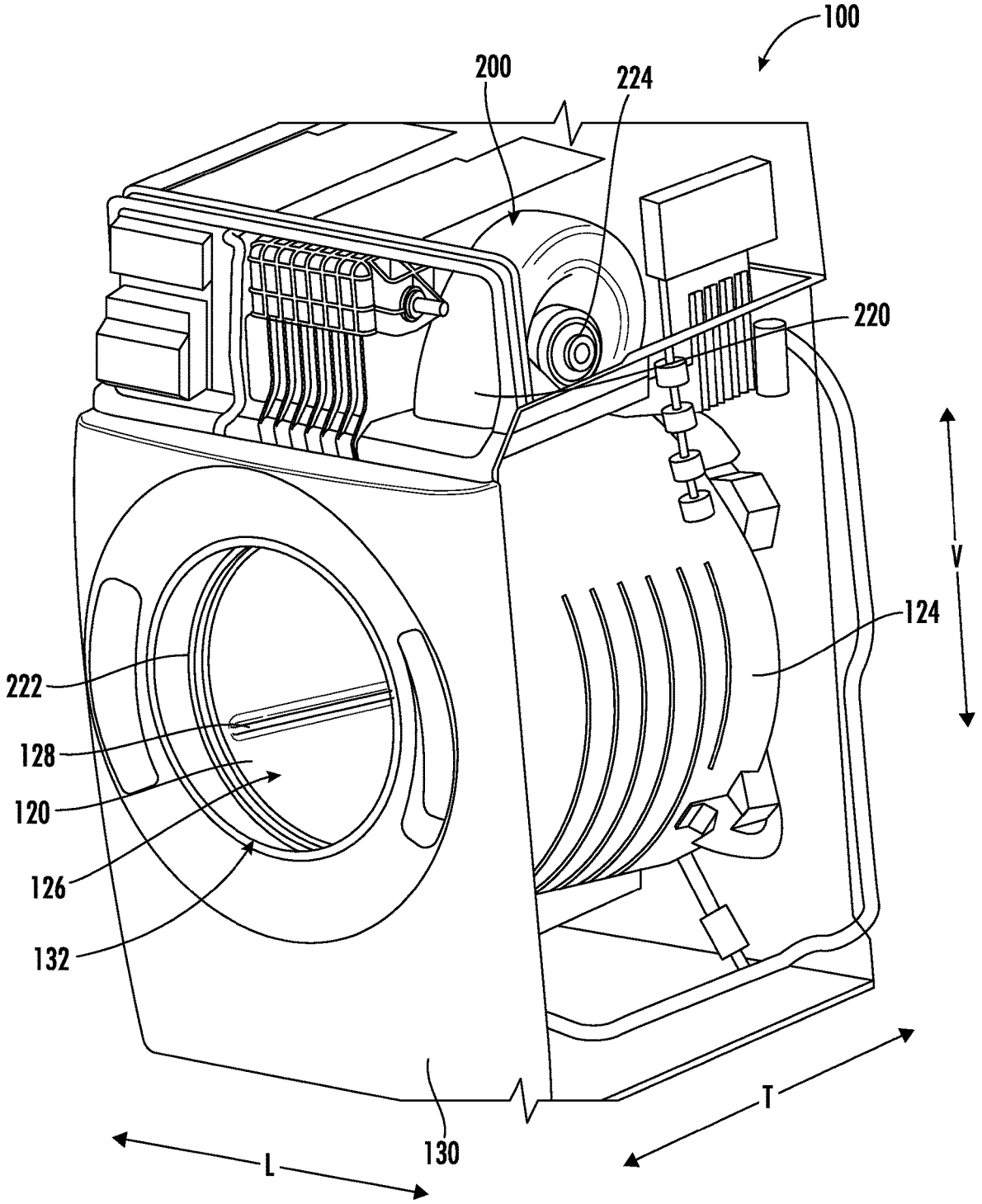
FIG. 5 provides a perspective view of the example laundry appliance of FIG. 1 with an upper panel of the laundry appliance removed to reveal certain components of the dryer appliance.
Figure 6:
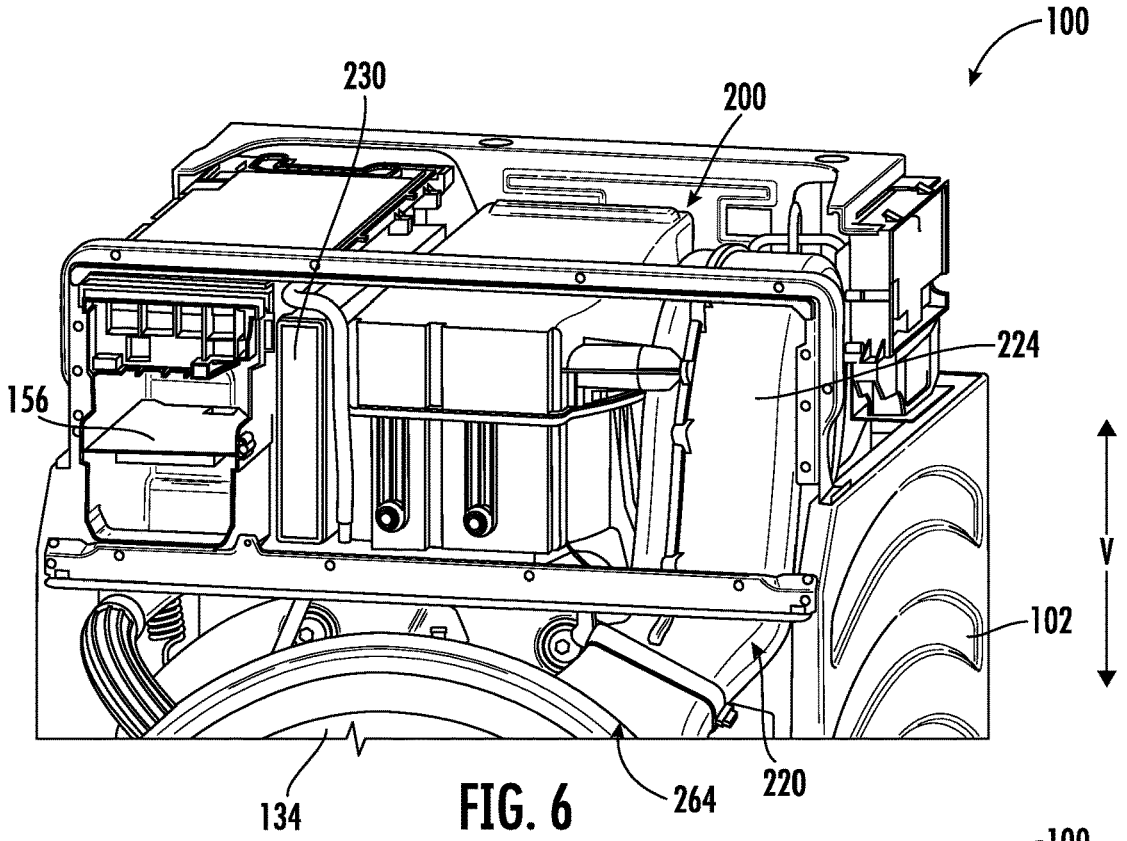
FIG. 6 provides a perspective view of the example conditioning system of FIG. 3 with the upper panel removed in accordance with exemplary embodiments of the present disclosure.

Referring now to the figures, an exemplary laundry appliance that may be used to implement aspects of the present subject matter will be described. Specifically, FIG. 1 is a perspective view of an exemplary horizontal axis washer and condenser dryer combination appliance 100, referred to herein for simplicity as laundry appliance 100. FIG. 2 is a side cross-sectional view of laundry appliance 100. FIG. 4 is a perspective view of laundry appliance 100 with cabinet 102 removed. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted within cabinet 102 such that it is rotatable about an axis of rotation A. According to the illustrated embodiment, axis of rotation A is substantially parallel to or slightly inclined relative to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle of laundry appliance 100). Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together and/or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 also includes a front panel 130 which defines an opening 132 that permits user access to laundry basket 120 and tub 124. More specifically, laundry appliance 100 includes a door assembly 134 that is positioned over opening 132 and is rotatably mounted to front panel 130. In this manner, door assembly 134 permits selective access to opening 132 by being movable between an open position (not shown) facilitating access to a tub 124 and a closed position (FIG. 1) prohibiting access to tub 124. Laundry appliance 100 may further include a latch assembly that is mounted to cabinet 102 and/or door assembly 134 for selectively locking door assembly 134 in the closed position. The latch assembly may be desirable, for example, to ensure only secured access to chamber 126 or to otherwise ensure and verify that door assembly 134 is closed during certain operating cycles or events.

A window 138 in door assembly 134 permits viewing of laundry basket 120 when door assembly 134 is in the closed position, e.g., during operation of laundry appliance 100. Door assembly 134 also includes a handle (not shown) that, e.g., a user may pull when opening and closing door assembly 134. Further, although door assembly 134 is illustrated as mounted to front panel 130, it should be appreciated that door assembly 134 may be mounted to another side of cabinet 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and washing operation is initiated through operator manipulation of input selectors 162. Tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the amount of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, and/or rinsed, the user can remove the articles from laundry basket 120, e.g., by opening door assembly 134 and reaching into laundry basket 120 through opening 132.

While described in the context of a specific embodiment of horizontal axis laundry appliance 100, using the teachings disclosed herein it will be understood that horizontal axis laundry appliance 100 is provided by way of example only. Other laundry appliances having different configurations, different appearances, and/or different features may also be utilized with the present subject matter as well, e.g., vertical axis laundry appliances. Indeed, it should be appreciated that aspects of the present subject matter may further apply to other laundry appliances.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, e.g., directly through a local area network (LAN), Wi-Fi, Bluetooth, Zigbee, etc. or indirectly through network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with laundry appliance 100 and/or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP. SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
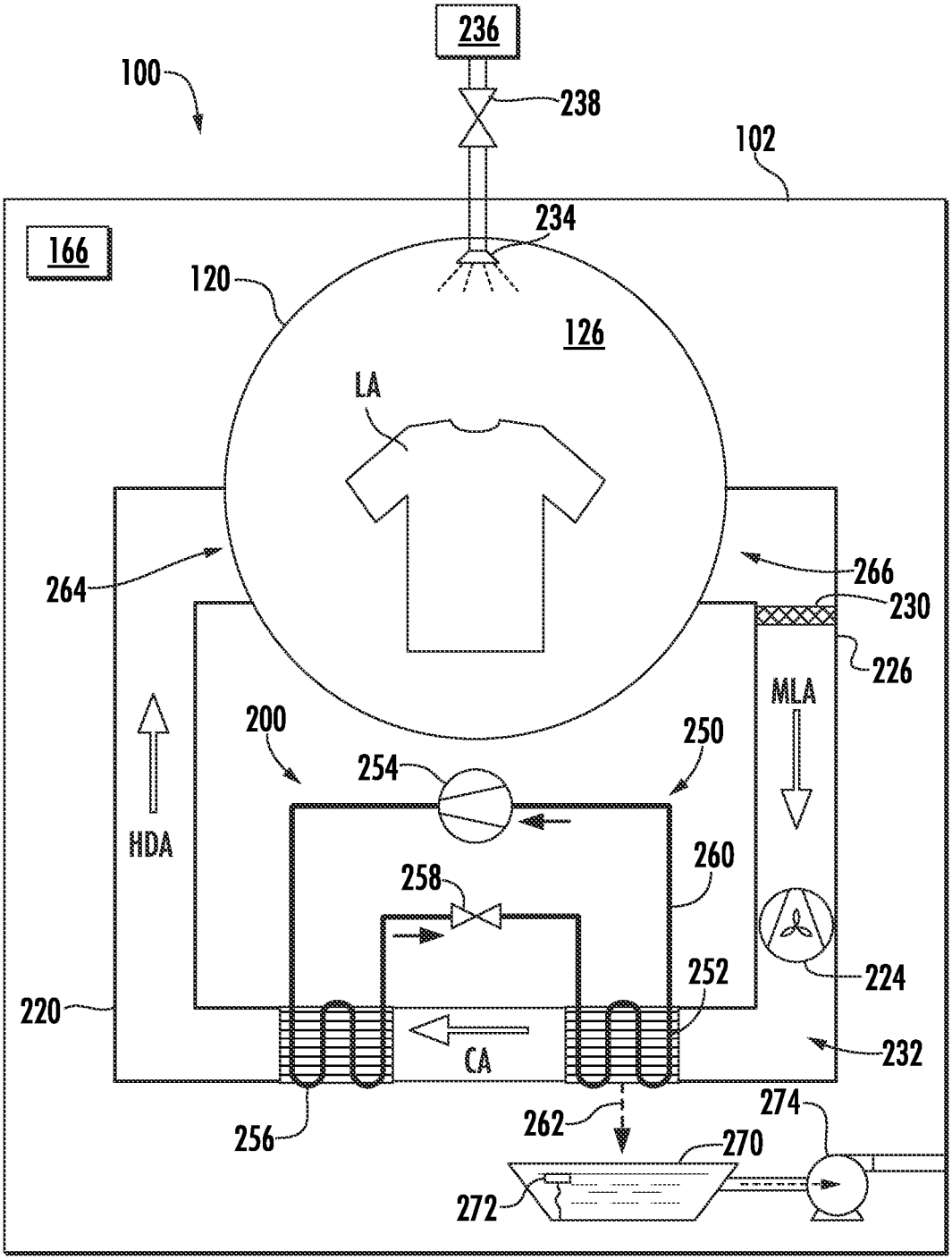
FIG. 3 provides a schematic diagram of an exemplary heat pump dryer appliance and a conditioning system thereof in accordance with exemplary embodiments of the present disclosure.

Referring now specifically to FIGS. 2 through 4, a heat pump system, a condenser system, a refrigerant-based air conditioning system, or another suitable conditioning system 200 for facilitating a drying process within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet 102 by a suitable bearing and/or may be fixed or rotatable.

Laundry basket 120 is generally cylindrical in shape. Laundry basket 120 has an outer cylindrical wall 208 and a front flange or wall that defines an opening 210 of laundry basket 120, e.g., at front portion 202 of laundry basket 120. As shown, opening 210 generally coincides with opening 132 of front panel 112 of cabinet 102, e.g., to provide user access to chamber 126 for loading and unloading of articles into and out of chamber 126 of laundry basket 120.

Conditioning system 200 may generally include a supply duct 220 that is mounted to tub 124 for circulating air within chamber 126 to facilitate a drying process. For example, according to the illustrated exemplary embodiment, supply duct 220 is fluidly coupled to tub 124 proximate opening 132 of front panel 130. More specifically, according to an example embodiment, supply duct 220 passes through a door gasket 222 that is mounted to tub 124 at opening 132 and is configured for forming a seal with door assembly 134 when door assembly 134 is in a closed position. Supply duct 220 receives heated air that has been heated and/or dehumidified by a conditioning system 200 and provides the heated air to laundry basket 120 via supply duct 220.

Specifically, moisture laden, heated air is drawn from laundry basket 120 by an air handler, such as a blower fan 224, which generates a negative air pressure within laundry basket 120. As the air passes from blower fan 224, it is circulated through chamber 126, enters a return duct 226, and then is passed into conditioning system 200. In some embodiments, the conditioning system 200 may be or include an electric heating element, e.g., a resistive heating element, or a gas-powered heating element, e.g., a gas burner. According to the illustrated exemplary embodiment, laundry appliance 100 is a heat pump dryer appliance and thus conditioning system 200 may be or include a heat pump including a sealed refrigerant circuit, as described in more detail below with reference to FIGS. 3 and 4. Heated air (with a lower moisture content than was received from laundry basket 120), exits conditioning system 200 and returns to laundry basket 120 by a supply duct 220. After the clothing articles have been dried, they are removed from the laundry basket 120 via opening 132.

As shown, laundry appliance 100 may further include one or more lint filters 230 (FIG. 3) to collect lint during drying operations. The moisture laden heated air passes through return duct 226 enclosing screen filter 230, which traps lint particles. More specifically, filter 230 may be placed into an air flow path 232 defined by laundry basket 120, conditioning system 200, return duct 226, and supply duct 220. Filter 230 may be positioned in the process air flow path 232 and may include a screen, mesh, or other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying cycles.

According to exemplary embodiments, laundry appliance 100 may facilitate a steam dry process. In this regard, laundry appliance 100 may offer a steam drying cycle, during which steam is injected into chamber 126, e.g., to function similar to a traditional garment steamer to help remove wrinkles, static, etc. Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet 102.

FIG. 3 provides a schematic view of laundry appliance 100 and depicts conditioning system 200 in more detail. FIG. 4 provides a perspective view of tub 124 with conditioning system 200 positioned on top of tub 124. For this embodiment, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for heating process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser. As an example, sealed system 250 may include two (2) evaporators.

In performing a drying and/or tumbling cycle, one or more laundry articles LA may be placed within the chamber 126 of laundry basket 120. Hot dry air HDA is supplied to chamber 126 via supply duct 220. The hot dry air HDA enters chamber 126 of laundry basket 120 via a supply opening 264 defined by laundry basket 120, e.g., the plurality of holes defined in rear wall 206 and/or cylindrical wall 208 of laundry basket 120 as shown in FIG. 2. The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a return opening 266 defined by laundry basket 120 and flows into return duct 226.

After exiting chamber 126 of laundry basket 120, the warm moisture laden air MLA flows downstream to conditioning system 200. Blower fan 224 moves the warm moisture laden air MLA, as well as the air more generally, through a process air flow path 232 defined by laundry basket 120, conditioning system 200, return duct 226, and supply duct 220. Thus, generally, blower fan 224 is operable to move air through or along the process air flow path 232. The duct system includes all ducts that provide fluid communication (e.g., airflow communication) between return opening 266 and conditioning system 200 and between conditioning system 200 and supply opening 264. Although blower fan 224 is shown positioned between laundry basket 120 and conditioning system 200 along return duct 226, it will be appreciated that blower fan 224 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA—thereby reducing its temperature. As a result, moisture in the air is condensed and such condensate water may be drained from conditioning system 200, e.g., using a drain line 262, which is also depicted in FIG. 3.

For this embodiment, a condenser tank or a condensate collection tank 270 is in fluid communication with conditioning system 200, e.g., via drain line 262. Collection tank 270 is operable to receive condensate water from the process air flowing through conditioning system 200, and more particularly, condensate water from evaporator 252. A sensor 272 is operable to detect when water within collection tank 270 has reached a predetermined level. Sensor 272 can be any suitable type of sensor, such as a float switch as shown in FIG. 3. Sensor 272 can be communicatively coupled with controller 166, e.g., via a suitable wired or wireless communication link. A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream, e.g., to a gray water collection system. Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at return opening 266. As shown in FIG. 3, cool air CA (cool relative to hot dry air HDA and moisture laden air MLA) flowing downstream of evaporator 252 is subsequently caused to flow across condenser 256, e.g., across coils or tubing thereof, which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to laundry basket 120 of laundry appliance 100. The warm dry air HDA passes over and around laundry articles LA within the chamber 126 of the laundry basket 120, such that warm moisture laden air MLA is generated, as mentioned above. Because the air is recycled through laundry basket 120 and conditioning system 200, laundry appliance 100 can have a much greater efficiency than traditional clothes dryers can where all of the warm, moisture-laden air MLA is exhausted to the environment.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

Although laundry appliance 100 is depicted and described herein as a heat pump dryer appliance, the inventive aspects of the present disclosure can apply to other types of closed loop airflow circuit dryer appliances. For instance, in other embodiments, laundry appliance 100 can be a condenser dryer that utilizes an air-to-air heat exchanger instead of evaporator 252 and/or an electric heater may be provided instead of condenser 256. Thus, in such embodiments, the working fluid that interacts thermally with the process air may be air. In yet other embodiments, laundry appliance 100 can be a spray tower dryer appliance that utilizes a water-to-air heat exchanger instead of utilizing a sealed refrigerant. Thus, in such embodiments, the working fluid that interacts thermally with the process air may be water. Further, in some embodiments, laundry appliance 100 can be a combination washer/dryer appliance having a closed loop airflow circuit along which process air may flow for drying operations.

Referring now also to FIGS. 5 through 9, door assembly 134 will be described in more detail according to an example embodiment of the present subject matter. In this regard, as explained above, supply duct 220 and/or return duct 226 may be generally positioned proximate front 112 of cabinet 102, e.g., at a front of chamber 126. According to example embodiments, supply duct 220 and return duct 226 are defined through a stationary portion of the door gasket 222. In this regard, supply duct 220 may terminate in a supply opening 264 that is defined in door gasket 222 and return duct 226 may be fluidly coupled to chamber 126 through a return opening 266.

Notably, as explained briefly above, conventional laundry appliance doors may include a window that extends at least partially into chamber 126. For example, these windows may facilitate proper water collection, improve the tumbling process of clothes, or may provide other operational benefits to the laundry appliance. However, such windows may also frequently disturb the flow of air (e.g., such as a flow of process air 304 that passes through airflow path 232). More specifically, windows of conventional doors may be positioned at least partially within the air flow path, resulting in an impingement of the flow of process air 304 onto the window. Notably, this impingement and resulting pressure rise may affect the drying performance of the laundry appliance. Accordingly, aspects of the present subject matter are directed to door assemblies that facilitate improved airflow and drying performance.

Figure 7:
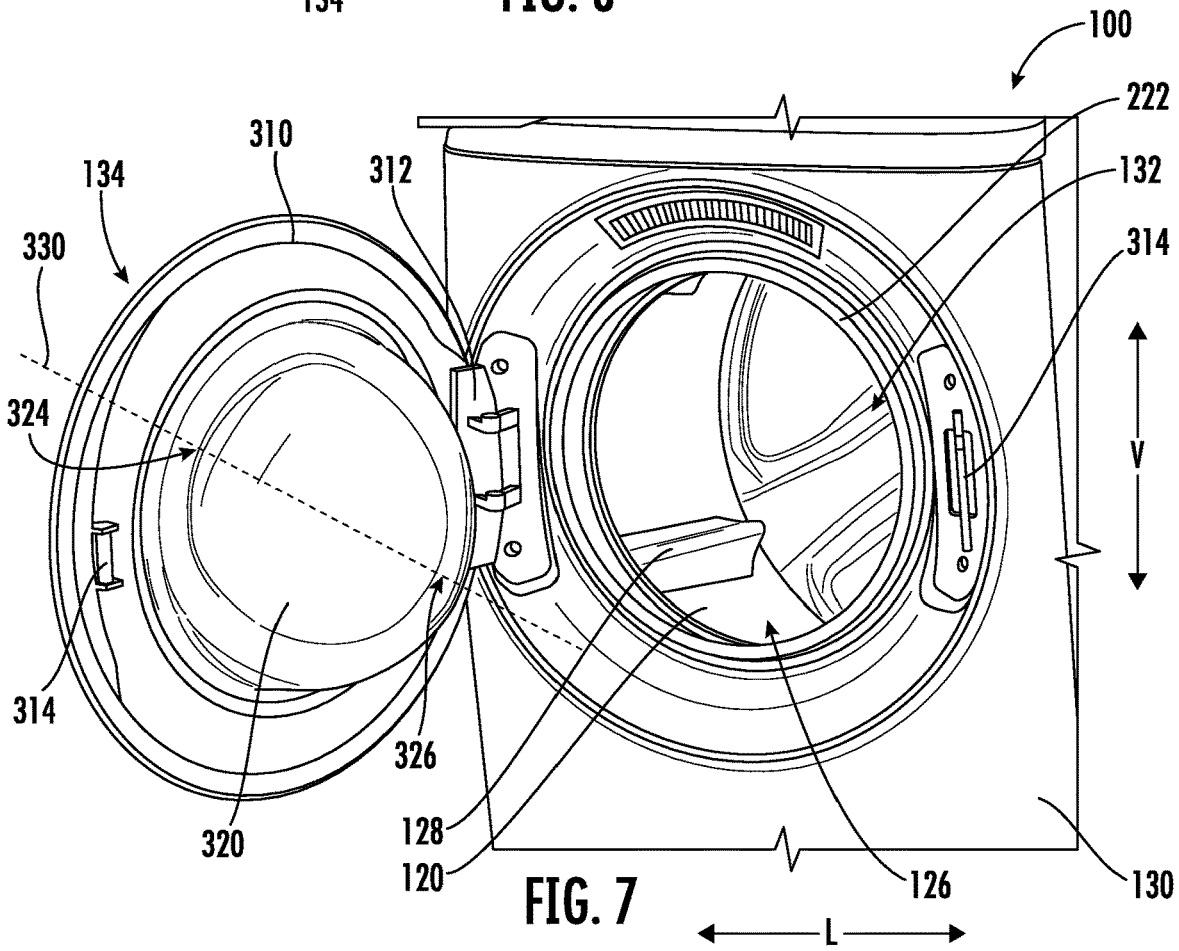
FIG. 7 provides a perspective view of the example laundry appliance of FIG. 1 with a door assembly of the laundry appliance in an open position in accordance with exemplary embodiments of the present disclosure.

For example, according to the illustrated embodiment, door assembly 134 may generally include a door frame 310 that is rotatably mounted to cabinet 102. In this regard, door frame 310 may be configured to receive a hinge assembly 312 on one lateral side of door frame 310 and a latch assembly 314 on an opposite lateral side of door frame 310. In this regard, according to the illustrated embodiment, hinge assembly 312 is positioned on a left side of door frame 310 when viewed from a front of laundry appliance 100. In addition, hinge assembly 312 may permit door frame 310 to rotate about a vertical direction V. e.g., along a vertical axis defined through hinge assembly 312. Specifically, hinge assembly 312 may permit door assembly 134 to rotate between the closed position (e.g., as shown in FIG. 1) and the open position (e.g., as shown in FIG. 7).

In addition, according to the illustrated embodiment, door assembly 134 may generally include an inner window 320 and an outer window 322 (which may correspond to window 138) that are spaced apart from each other. According to the illustrated embodiment, inner window 320 is mounted within door frame 310. As explained above, conventional windows assemblies of door assemblies include a thin upper end that extends only partially into the chamber and a thicker lower end that extends more fully into the chamber. In this regard, conventional inner windows are symmetric about an axis that extends along the vertical direction V.

By contrast, inner window 320 of door assembly 134 may generally define a low point 324 and a high point 326. In general, the terms "low point" and the like are generally intended to refer to the portion of inner window 320 that extends the least into chamber 126 along the transverse direction T. In other words, the low point 324 corresponds to the thinnest portion of inner window 320 or door assembly 134. By contrast, the terms "high point" and the like are generally intended to refer to the portion of inner window 320 that extends the most into chamber 126 along the transverse direction T. In other words, the high point 326 corresponds to the thickest portion of inner window 320 or door assembly 134.

Notably, in order to improve the flow of process air 304 and reduce blockages due to door assembly 134, low point 324 may generally be oriented toward or centered within supply opening 264, whereas a high point 326 may generally be oriented away from supply opening 264. According to example embodiments, low point 324 of inner window 320 may be sized and positioned such that low point 324 is not positioned over any portion of supply opening 264 when door assembly 134 is in a closed position. In this manner, low point 324 may have a tendency to scoop the flow of process air 304 which may be guided along inner window 320 for improved aerodynamics within chamber 126.

Figure 8:
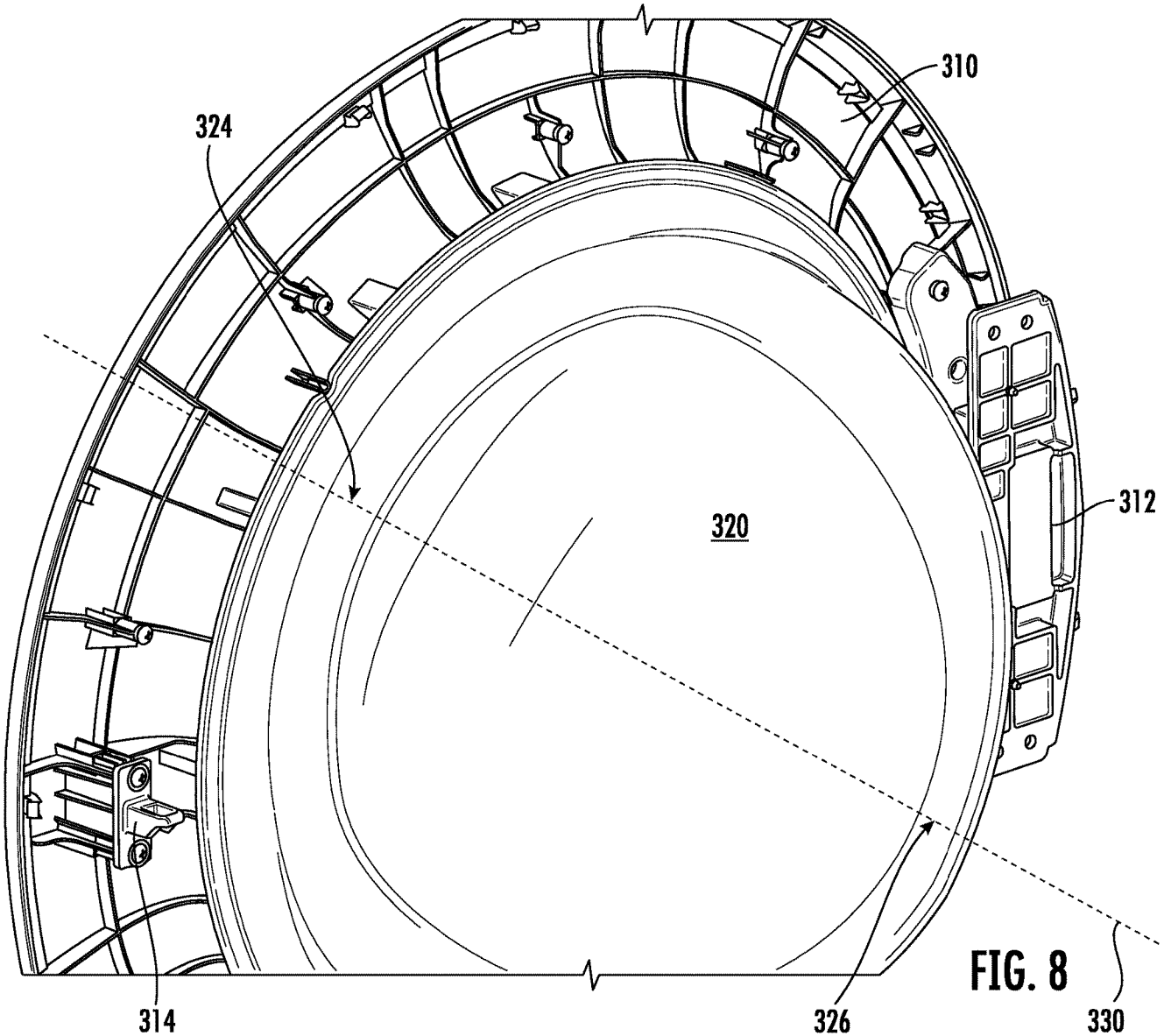
FIG. 8 is a rear perspective of the example door assembly of FIG. 7 in accordance with exemplary embodiments of the present disclosure.
Figure 9:
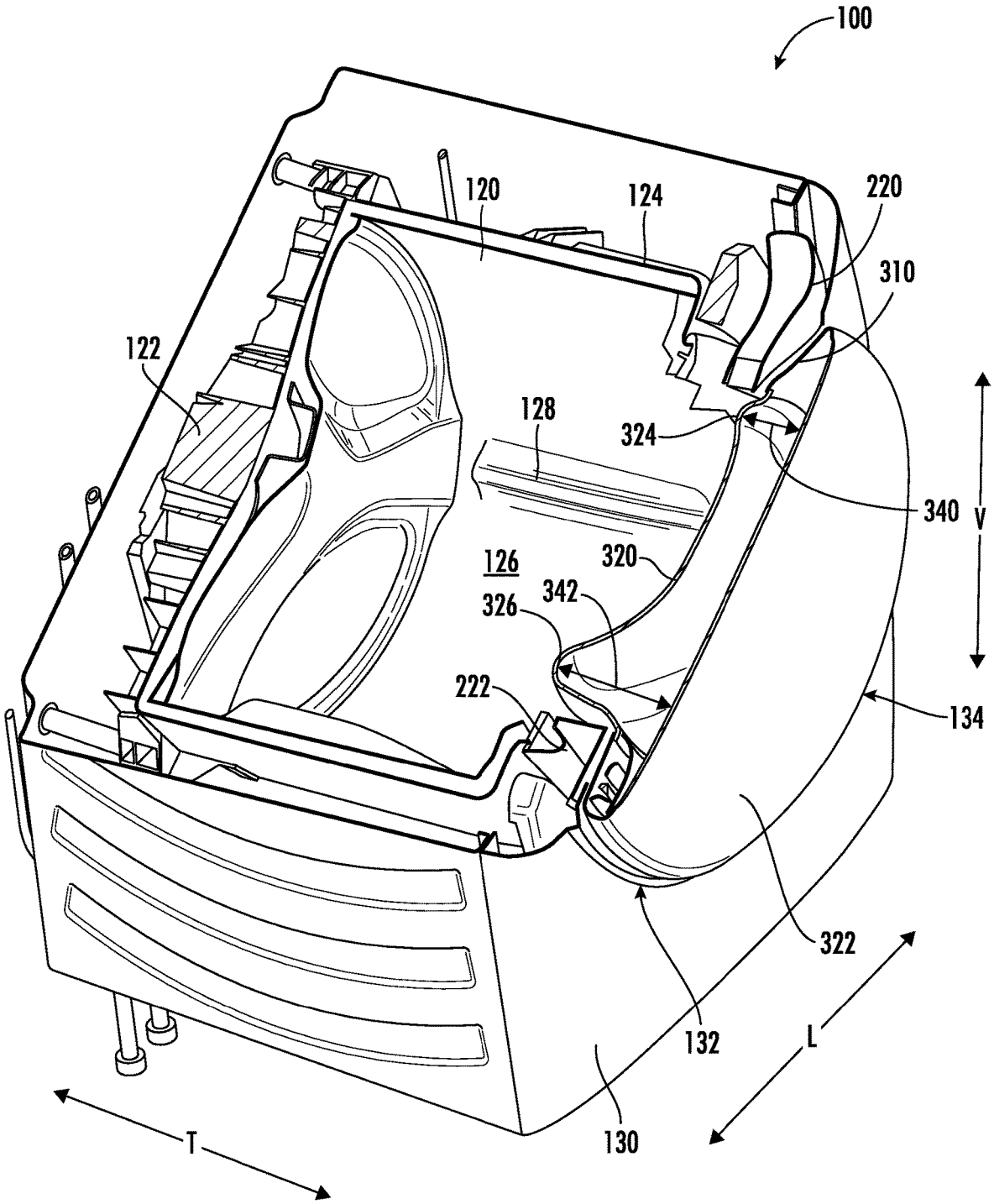
FIG. 9 is a perspective cross-sectional view of the exemplary laundry appliance of FIG. 1 in accordance with exemplary embodiments of the present disclosure.

In addition, as best illustrated in FIGS. 7 and 8, inner window 320 may generally define an arcuate profile between low point 324 and a high point 326. For example, inner window 320 may define a concave profile when viewed from within chamber 126. Notably, other suitable profiles of inner window 320 that may improve the fluid dynamics and flow of air within laundry appliance 100 may be used while remaining within the scope of the present subject matter.

Notably, the alignment of inner window 320 and the corresponding positioning of low point 324 and high point 326 may be varied to improve the flow of process air 304, reduce back pressures, and improve overall drying performance of laundry appliance 100. For example, according to the illustrated embodiment, supply opening 264 and low point 324 may generally be positioned between a 1 o'clock position and a 2 o'clock position of front opening 132 when viewed from front 112 of the cabinet 102. For example, when measured relative to the vertical direction V, supply opening 130 may be positioned at between about 15° and 75°, between about 30° and 60°, or at about 45° measured clockwise from the vertical direction V.

By contrast, according to an example embodiment, high point 326 may generally be positioned 180° opposite of low point 324. For example, high point 326 may be positioned between a 7 o'clock position and an 8 o'clock position of front opening 132 when viewed from front 112 of the cabinet 102. For example, when measured relative to the vertical direction V, high point 326 may be positioned at between about 195° and 255°, between about 210° and 240°, or at about 225° measured clockwise from the vertical direction V. According to still other embodiments, the positions of supply opening 264 may be mirrored (e.g., on an opposite side of the appliance), in which case the positions of the low point 324 and high point 326 may be mirrored as well.

In addition, inner window 320 may generally define an alignment line 330 that extends between low point 324 and a high point 326. According to example embodiments, alignment line 330 may generally be parallel to the flow of process air 304 as it exits supply opening 264. In this manner, the flow of process air 304 may flow directly into chamber 126 with little or no loss of momentum or energy. This may result in improved drying performance.

According to the illustrated embodiment, door assembly 134 may generally define a first width 340 that is measured between outer window 322 and low point 324 of inner window 320 along the transverse direction T. In addition, door assembly 134 may generally define a second width 342 that is measured between outer window 322 and high point 326 of inner window 320 along the transverse direction T. According to example embodiments, second width 342 may be greater than two times, greater than four times, greater than six times, greater than eight times, greater than 10 times, or greater than first width 340. Other suitable geometries, sizes, and configurations of door assembly 134 and inner window 320 are possible and within the scope of the present subject matter.

As explained herein, aspects of the present subject matter are generally directed to a novel door assembly for a combination washer/dryer appliance. In general, the door assembly includes a central window that is curved between a low point (e.g., where the window protrudes a least amount into the chamber) and a high point (e.g., where the window protrudes farthest into the chamber). Conventional windows define the "belly" or the high point at the bottom of the window and the low point at the top of the window. By contrast, the present disclosure is directed to a door assembly with a low point immediately adjacent an air inlet where process air is directed into the chamber and with the high point positioned opposite the air inlet. For example, the window and/or door frame may define clocking features (e.g., such as female notches and male tabs) that properly align the window within the door frame, e.g., at a particular angular orientation relative to the door hinges.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:
a cabinet defining a front opening;
a tub positioned within the cabinet;
a wash basket rotatably mounted within the tub, the wash basket defining a chamber for receipt of articles for washing and drying;
a conditioning system configured to heat and remove moisture from air flowing therethrough, the conditioning system comprising a compressor, an evaporator, and a condenser;
a supply duct fluidly coupled to the conditioning system for providing a flow of process air into the chamber through a supply opening; and
a door assembly rotatably mounted to the cabinet to provide selective access to the chamber through the front opening, the door assembly comprising:
a door frame rotatably mounted to the cabinet; and
a window mounted within the door frame, the window defining a low point and a high point, the low point being oriented toward the supply opening, wherein the window defines an alignment line that extends between the low point and the high point, and wherein the alignment line is parallel to a process air flow path exiting the supply opening.

2. The laundry appliance of claim 1, wherein the supply opening and the low point of the window are positioned between a 1 o'clock position and a 2 o'clock position or between a 10 o'clock position and an 11 o'clock position of the front opening when viewed from a front of the cabinet.

3. The laundry appliance of claim 2, wherein the high point of the window is positioned between a 7 o'clock position and an 8 o'clock position or between a 4 o'clock position and a 5 o'clock position of the front opening when viewed from the front of the cabinet.

4. The laundry appliance of claim 1, wherein the window defines a first width at the low point and a second width at the high point, wherein the second width is greater than two times the first width.

5. The laundry appliance of claim 4, wherein the second width is greater than four times the first width.

6. The laundry appliance of claim 1, wherein the window defines an arcuate profile between the low point and the high point.

7. The laundry appliance of claim 6, wherein the window is concave when viewed from the chamber.

8. The laundry appliance of claim 1, wherein the low point of the window is not positioned over any portion of the supply opening when the door assembly is in a closed position.

9. The laundry appliance of claim 1, wherein the window is an inner window of the door assembly, the door assembly further comprising an outer window spaced apart from the inner window.

10. The laundry appliance of claim 1, wherein the supply duct is part of a duct system for providing fluid communication between the chamber and the conditioning system, wherein the duct system, the conditioning system, and the wash basket define a process air flow path, the laundry appliance further comprising:

a blower fan operable to move the flow of process air through the process air flow path.

11. The laundry appliance of claim 1, wherein the laundry appliance is a heat pump dryer appliance or a combination washer and heat pump dryer appliance.

12. A door assembly for a laundry appliance, the laundry appliance comprising a cabinet defining a front opening, a tub positioned within the cabinet, a wash basket rotatably mounted within the tub and defining a chamber, and a supply duct fluidly coupled to a conditioning system for providing a flow of process air into the chamber through a supply opening, the door assembly comprising:

a door frame rotatably mounted to the cabinet to provide selective access to the chamber through the front opening; and a window mounted within the door frame, the window defining a low point and a high point, the low point being oriented toward the supply opening, wherein the window defines an alignment line that extends between the low point and the high point, and wherein the alignment line is parallel to a process air flow path exiting the supply opening.

13. The door assembly of claim 12, wherein the supply opening and the low point of the window are positioned between a 1 o'clock position and a 2 o'clock position or between a 10 o'clock position and an 11 o'clock position of the front opening when viewed from a front of the cabinet.

14. The door assembly of claim 13, wherein the high point of the window is positioned between a 7 o'clock position and an 8 o'clock position or between a 4 o'clock position and a 5 o'clock position of the front opening when viewed from the front of the cabinet.

15. The door assembly of claim 12, wherein the window defines a first width at the low point and a second width at the high point, wherein the second width is greater than two times the first width.

16. The door assembly of claim 12, wherein the window defines an arcuate profile between the low point and the high point.

17. The door assembly of claim 16, wherein the window is concave when viewed from the chamber.

18. The door assembly of claim 12, wherein the low point of the window is not positioned over any portion of the supply opening when the door assembly is in a closed position.

* * * * *